US011291282B2

(12) United States Patent
Powell et al.

(10) Patent No.: US 11,291,282 B2
(45) Date of Patent: Apr. 5, 2022

(54) JEWELRY BOX

(71) Applicants: Spencer Christian Powell, Maryland Heights, MO (US); Kristin Pennell Powell, Maryland Heights, MO (US); Steven Arthur Coxson, Prescott, AZ (US)

(72) Inventors: Spencer Christian Powell, Maryland Heights, MO (US); Kristin Pennell Powell, Maryland Heights, MO (US); Steven Arthur Coxson, Prescott, AZ (US)

( * ) Notice: Subject to any disclaimer, the term of this patent is extended or adjusted under 35 U.S.C. 154(b) by 0 days.

(21) Appl. No.: 15/670,516

(22) Filed: Aug. 7, 2017

(65) Prior Publication Data

US 2018/0035772 A1 Feb. 8, 2018

Related U.S. Application Data

(60) Provisional application No. 62/371,965, filed on Aug. 8, 2016.

(51) Int. Cl.

| | |
|---|---|
| ***A45C 11/16*** | (2006.01) |
| ***A45C 13/02*** | (2006.01) |
| ***B65D 6/00*** | (2006.01) |
| ***B65D 6/06*** | (2006.01) |

(52) U.S. Cl.

CPC ..... *A45C 11/16* (2013.01); *A45C 13/02* (2013.01); *B65D 7/10* (2013.01); *B65D 7/42* (2013.01); *B65D 11/12* (2013.01); *B65D 11/20* (2013.01); *A45C 2200/00* (2013.01)

(58) Field of Classification Search

CPC ..... A45C 11/16; A45C 13/02; B65D 7/10; B65D 7/42; B65D 11/12; B65D 11/20

USPC ..... 206/6.1, 730–737, 751, 754–756, 759, 206/762, 767, 768, 774, 528, 775

See application file for complete search history.

(56) References Cited

U.S. PATENT DOCUMENTS

| | | | | |
|---|---|---|---|---|
| 2,888,136 A | | 5/1959 | Borde | |
| 2,979,223 A | * | 4/1961 | Rideout | A24F 19/00 131/242 |
| 4,493,417 A | * | 1/1985 | Ackeret | G11B 23/023 206/311 |
| 4,854,656 A | | 8/1989 | O'Keefe | |
| 5,673,796 A | | 10/1997 | Tullock | |
| 5,979,661 A | | 11/1999 | Sherman | |
| 6,478,160 B1 | * | 11/2002 | Au | A45C 11/16 206/6.1 |
| 6,681,953 B2 | * | 1/2004 | Au | A45C 11/10 206/301 |

(Continued)

*Primary Examiner* — Rafael A Ortiz
(74) *Attorney, Agent, or Firm* — Grace J. Fishel

(57) ABSTRACT

A jewelry box comprising a lid, a drawer, a lift assembly and a jewelry holder; wherein the lid comprises a top, two parallel sides and an interior surface with opposing guide grooves on the interior surface of the sides; wherein the lid and drawer are sized to engage together and to slide to an opened position and a closed position; wherein the lift assembly is positioned in the drawer; the lift assembly having a down position when the lid and drawer are in the closed position and an up position when the lid and drawer are in the opened position; wherein the jewelry holder is positioned in the drawer attached to the lift assembly, and as the lift assembly moves from the down position to the up position, the jewelry holder pivots from the down position to the up position.

10 Claims, 9 Drawing Sheets

(56) References Cited

U.S. PATENT DOCUMENTS

| | | | |
|---|---|---|---|
| 2004/0159560 | A1 | 8/2004 | Viverito |
| 2011/0240492 | A1 | 10/2011 | Hinson |

* cited by examiner

JEWELRY BOX

CROSS-REFERENCE TO RELATED APPLICATIONS

This application claims the benefit of provisional patent application No. 62/371,965 filed on Aug. 8, 2016, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a jewelry box, and more particularly to a low profile jewelry box with a sliding lid.

Related Art

Prior art devices have been used for storing jewelry, particularly ring boxes to store rings. U.S. patent publication 2011/0240492 discloses a ring holder having a low profile and a pivoting ring holder. The disclosed ring holder has a base with a sliding lid that engages with a guide rail on the base. In the open position, the guide rail is exposed and susceptible to damage or clogging with particles of dust or debris, causing the sliding lid to malfunction. Aesthetically, the guide rail is not pleasing. Additionally, the mechanism for pivoting the ring holder involves two steps: (1) sliding the lid open and (2) pulling a tab fastened to the bottom of the lid which pivots the ring holder that is attached to the base housing. Applicant's simple one-step movement actuated by sliding the lid open moves the pins in guide slots and guide grooves to pivot the jewelry holder to the up position. The examples of known prior art devices are described in US2011/0240492, U.S. Pat. Nos. 2,888,136A, 4,493,417, 5,979,661, which are hereby incorporated by reference.

SUMMARY OF THE INVENTION

The present invention is a jewelry box comprising a lid, a drawer, a lift assembly and a jewelry holder. The lid comprises a top and two parallel sides, an interior surface and an exterior surface, and opposing guide grooves on the interior surface of the sides and parallel to the top with the grooves not extending through the sides to the exterior surface. The drawer comprises a bottom, a front wall, a rear wall, and two parallel drawer side walls, with the walls defining a space. The drawer has opposing guide slots through the side walls proximate to the rear wall and in part, aligned with the guide grooves. The drawer has opposing pin holes through the side walls proximate to the guide slots. The lid and drawer are sized to engage together and to slide from an opened position to a closed position. The lift assembly is positioned in the interior space of the drawer proximate to the rear wall and has an axis. The axis comprises a spring with a first end and a second end. The spring is biased downward, and positioned at the first and second ends are guide pins. The guide pins are moveably mounted through the opposing guide slots of the drawer and in the guide grooves of the lid. The lift assembly has a down position when the lid and drawer are in the closed position and an up position when the lid and drawer are in the opened position. The jewelry holder is positioned in the interior drawer space proximate to the lift assembly and has a jewelry container having a top, a bottom and a pivot point. The pivot point is positioned at the bottom of the container and has a pin having a pin first and a pin second end. The pin ends are rotatably engaged with the drawer pin holes, and a clip is fixedly engaged with the container and the spring so that as the lift assembly moves from the down position to the up position, the jewelry holder pivots from the down position to the up position so that the top of the jewelry container is rotated up.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
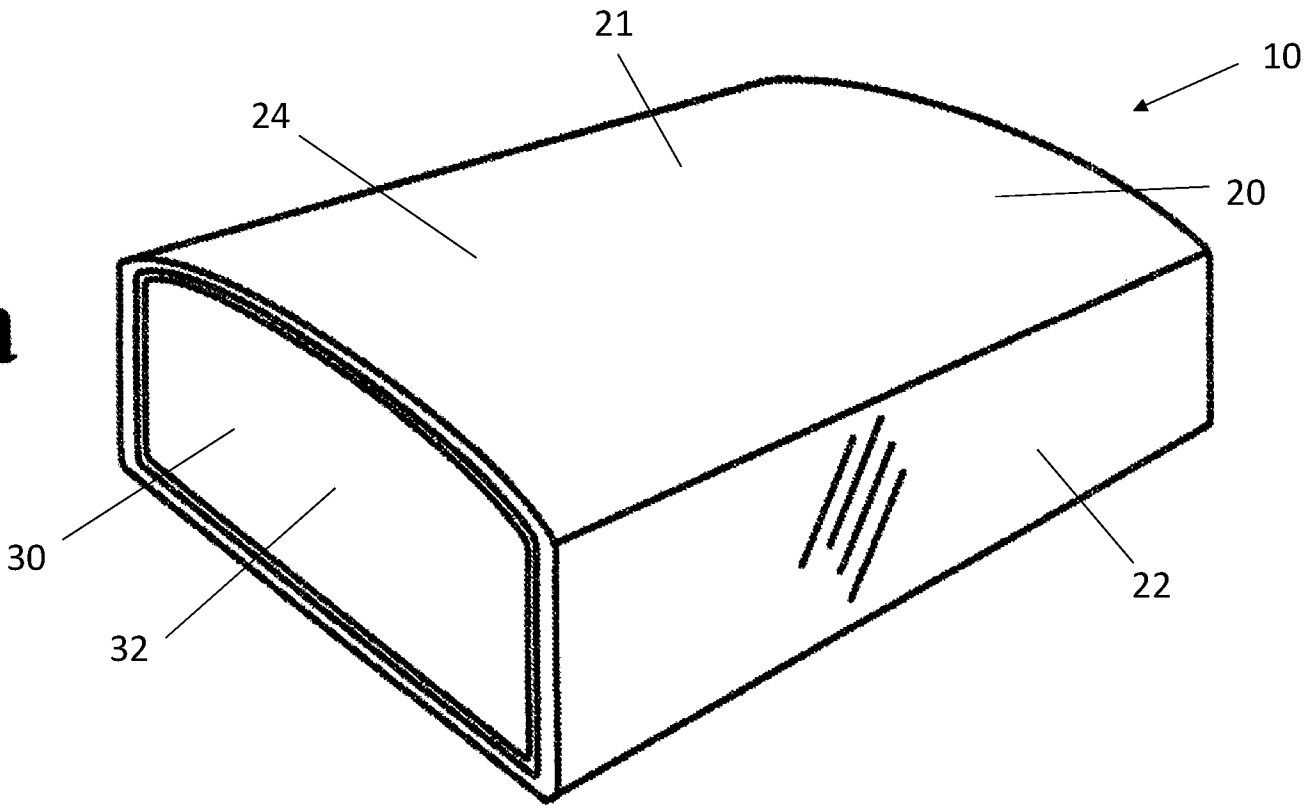
FIG. 1*a* is a perspective drawing of the jewelry box in a closed position.
Figure 1B:
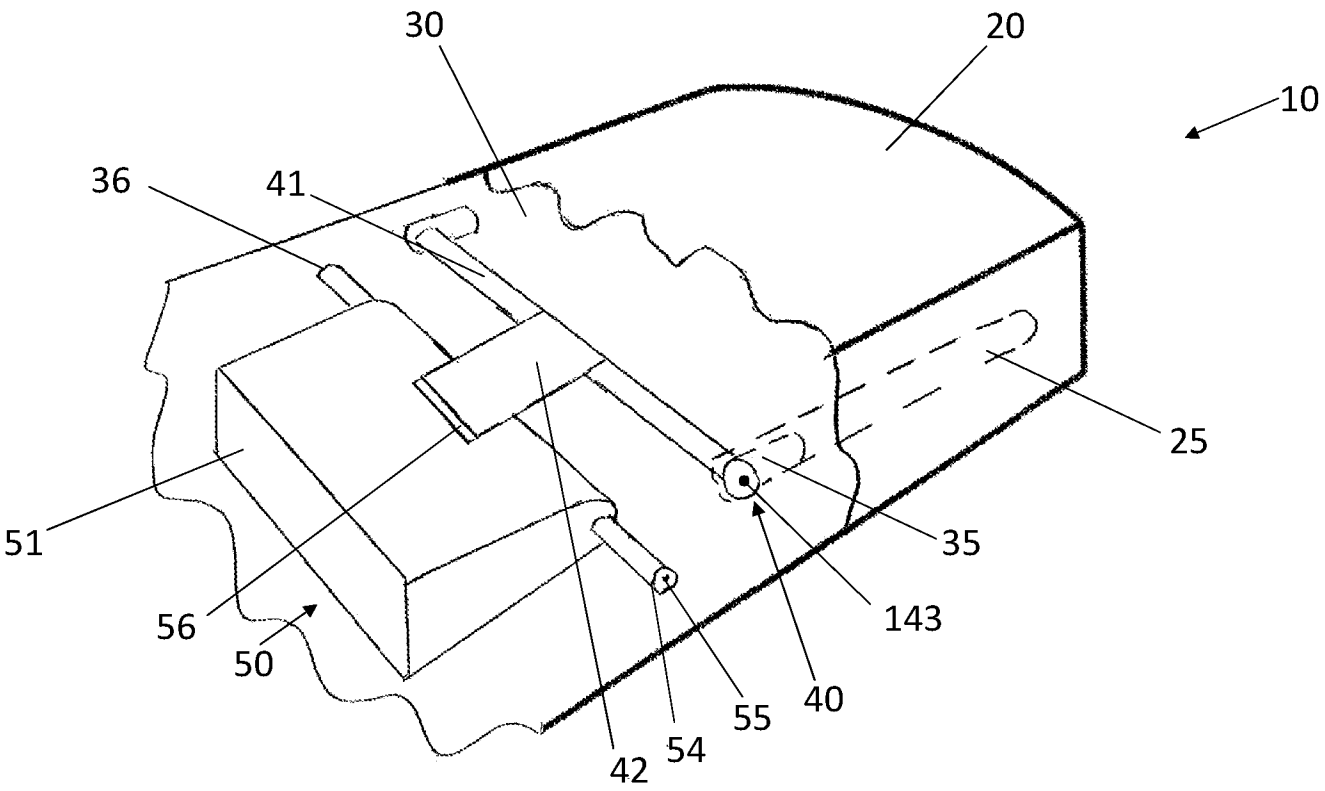
FIG. 1*b* is a cut-away perspective drawing of the jewelry box in a half opened position.
Figure 1C:
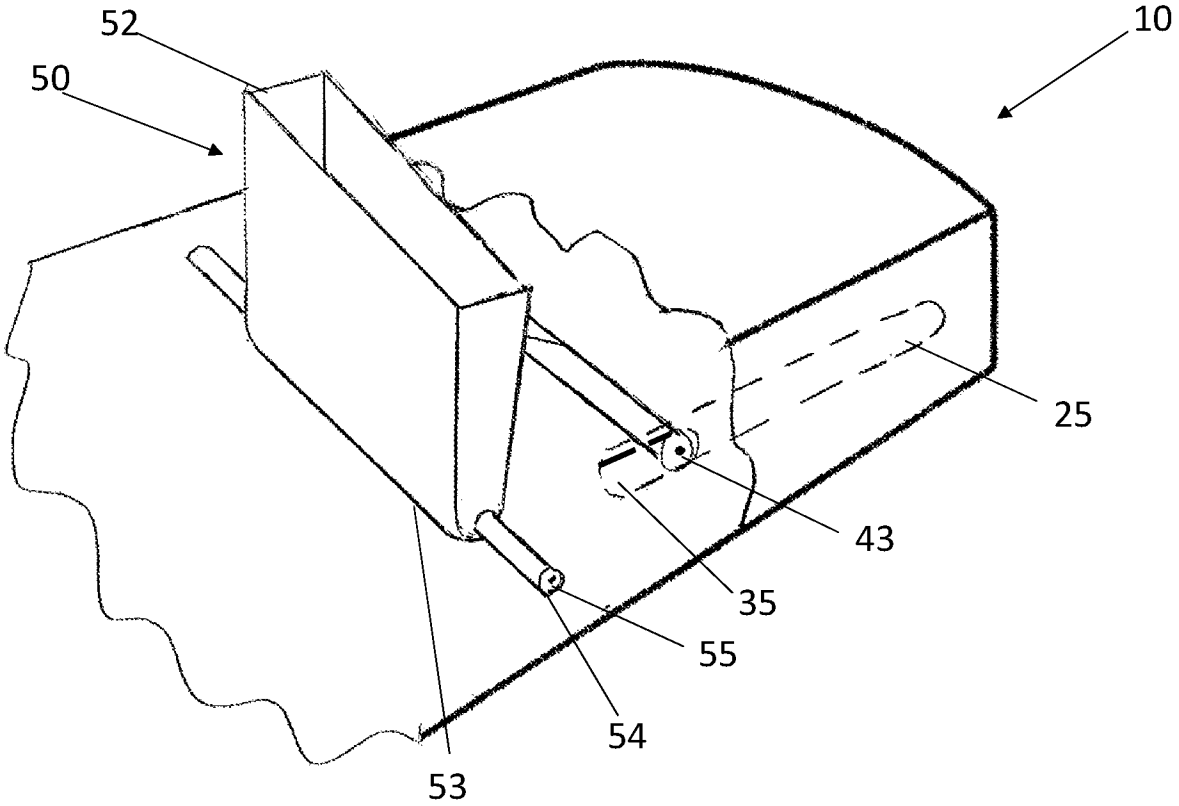
FIG. 1*c* is a cut-away perspective drawing of the jewelry box is a fully opened position.
Figure 2A:
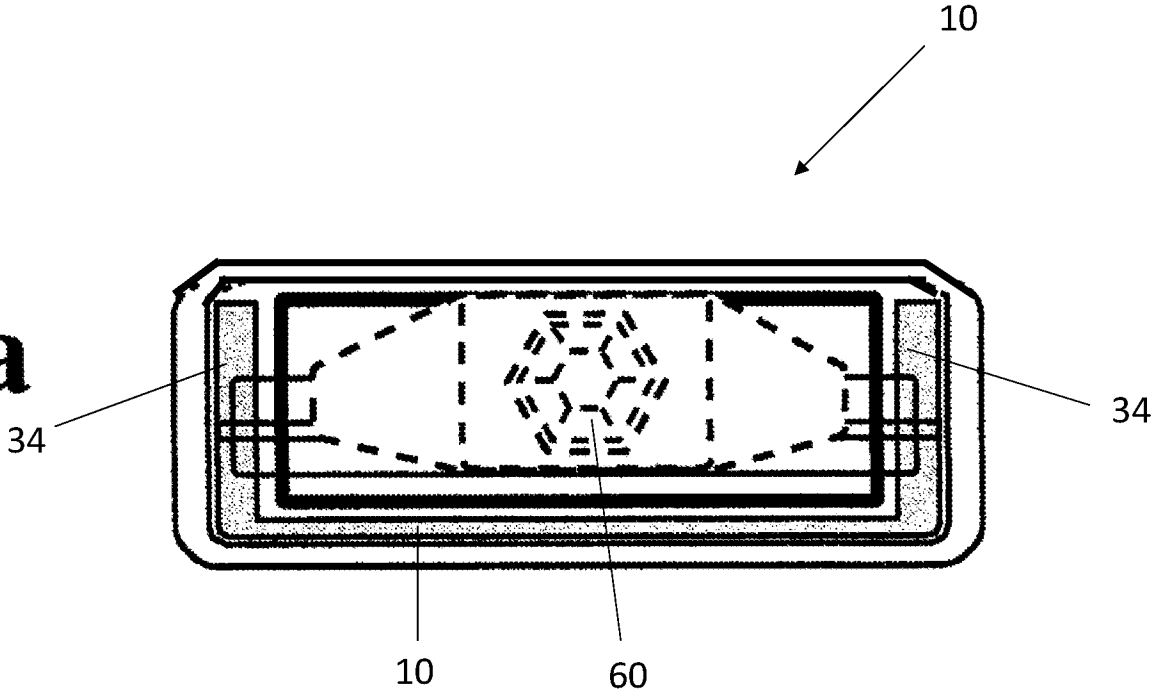
FIG. 2*a* is a front end view of the jewelry box in a closed position.
Figure 2B:
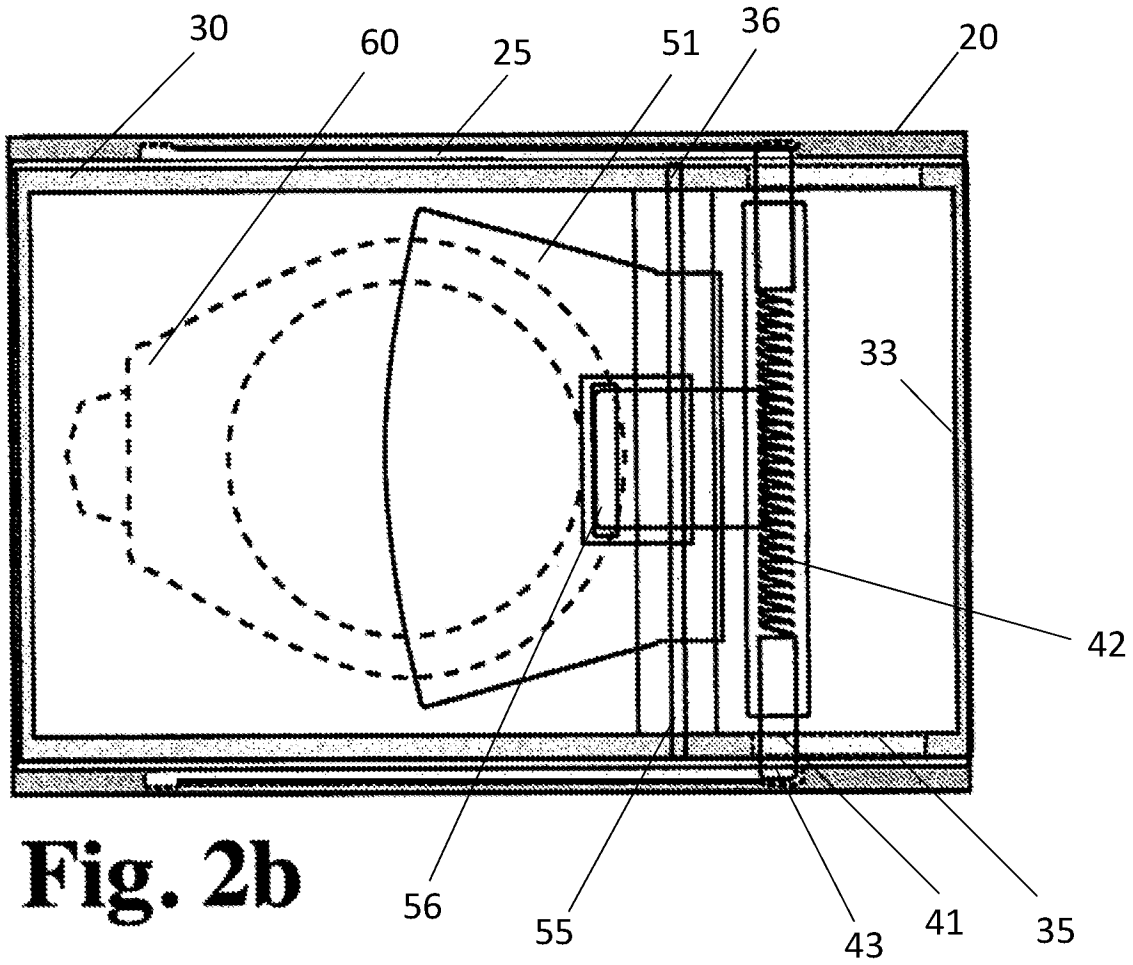
FIG. 2*b* is a top view of the jewelry box in a closed position.
Figure 2C:
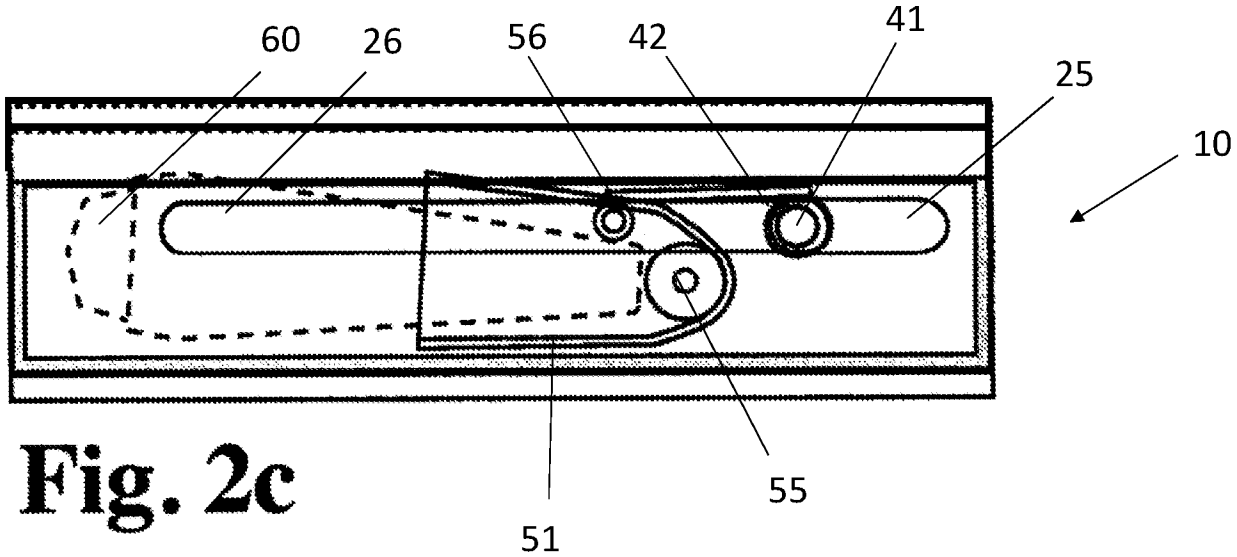
FIG. 2*c* is a side view of the jewelry box in a closed position.

The following description of the preferred embodiment(s) is merely exemplary in nature and is in no way intended to limit the invention, its application, or uses.

The jewelry box of the present invention provides a low profile jewelry box that is robust and attractive. The box has a sliding lid that has a top and parallel sides that engage with the drawer. The sides of the lid may extend partly down the sides of the drawer or completely down the sides of the drawer. In a preferred embodiment, the lid is a sleeve having a top, a bottom and parallel sides that fully enclose the drawer when in the closed position. Such a sleeve is shown in the FIGS. 1*a*-1*c*, 2*a*-2*c* and 3*a*-3*c*. The exterior surface of the lid is not marred with any type of grooves or guides that are part of the sliding mechanism.

The present invention is a jewelry box 10 having a lid 20, a drawer 30, a lift assembly 40 and a jewelry holder 50. The lid has a lid top 21 and two parallel lid sides 22, an interior surface 23 and an exterior surface 24. In a preferred embodiment, the lid top and the two parallel lid sides are planar. In a second preferred embodiment, the lid top had some curvature, while the sides are planar. The drawer is sized to nest moveably inside the lid. There are opposing guide grooves 25 on the interior surface at the sides and approximately parallel to the top. However, the grooves do not extend through the sides to the exterior surface. The exterior surface of the lid is not marred with grooves. The guide grooves may extend the length of the sides. In a preferred embodiment, the guide grooves stop short of the ends of the sides. In a more preferred embodiment, the guide grooves each have a stop 26 (typically an indent or notch or a groove closure) at each end so that the lid cannot be entirely slid off and accidently removed from the drawer.

The drawer 30 comprises a drawer bottom 31, a drawer front wall 32, a drawer rear wall 33, and two parallel drawer side walls 34 having exterior surfaces, the four walls defining an interior space 37. In a preferred embodiment, the four walls are planar. Opposing guide slots 35 are through the drawer side walls proximate to the rear wall. The guide slots are much shorter than the guide grooves, and for that short distance align with the guide grooves. Opposing pin holes 36 are through the side walls proximate to, but forward from the guide slots. The lid and drawer are sized to engage together and to have an opened position (FIG. 1*c*) and a closed position (FIG. 1*a*).

The lid and drawer of the jewelry box are designed to engage and fit together, so that when the lid is in the closed position, the drawer is completely covered by the lid, and so that the lid can slide to the open position, exposing the space within the drawer. In a preferred embodiment, when the lid is in the open position, the exposed exterior surfaces of the drawer side walls are unmarred by guide slots, which are obscured by the lid. Once again, the sliding mechanism of the drawer is not exposed to damage, dust or debris. The lid and drawer can be made of any material of sufficient strength to support and engage the two parts together. In a preferred embodiment, the lid and drawer are made of injection molded plastic. In a more preferred embodiment, the lid and drawer are made of metal, such as gold, silver or copper. Alloys such as bronze or stainless steel are also appropriate, as are combinations of metals. The exterior of the lid can be embellished with engravings, mounted jewels, embossing, and attached enhancements. The unmarred exterior lends itself to aesthetically pleasing effects.

The lift assembly 40 is positioned in the interior space 37 of the drawer proximate the rear wall and has an axis 41. The axis comprises a spring 42 with a first end and a second end. A preferred spring is a tension spring, however other types of springs are suitable for this device. In a preferred embodiment, the spring is biased downward, and positioned at the first and second ends are guide pins 43. The downward bias allows the lid to be in the closed position and the jewelry holder to be in the down position without the lid top pushing against the ring holder to move it down and to close it. Nor does the ring or jewelry holder rub or press against the lid when stored in the down position. The guide pins are moveably mounted through the opposing guide slots of the drawer and in the guide grooves of the lid. The lift assembly has a down position (see FIGS. 1*a* and 1*b*) when the lid and drawer are in the closed position and an up position (see FIG. 1*c*) when the lid and drawer are in the opened position.

The jewelry holder 50 is positioned in the drawer interior space 37 proximate to the lift assembly, and comprises a jewelry container 51 having a top 52, a bottom 53 and a pivot point 54. The pivot point is positioned at the bottom of the container and has a container pin 55 having a first and a second end, wherein the container pin ends are rotatably engaged with the drawer pin holes. A clip 56 is fixedly engaged with the container and the spring so that as the lift assembly moves from the down position to the up position, the jewelry holder pivots from the down position to the up position thereby moving upward the top of the jewelry container.

In a preferred embodiment, the pin is a swivel screw pin that can be removed when the holder is in the up position, allowing the jewelry holder to be removed from the jewelry box. The container can be one of a variety of shapes and uses. If the jewelry is a ring, a cup-shaped container consistent with the size and shape of the ring can be used. Alternatively, a clip can be used to secure the ring. A cylindrical or conical-shaped protrusion could also be used to secure a ring. A pendant, bracelet or necklace could be looped over a flat surface and held with a notch or notches, or a clip. A number of container types are suitable for this invention. The container is fixedly attached to the lift assembly by an attaching device, such as a clip. The attachment can be by any suitable means such as hooking, gluing, wiring or soldering. The attachment is such that as the lift assembly moves to the up position, the jewelry holder pivots to the up position. Likewise, as the lift assembly moves to the down position, the jewelry holder moves to the down position.

Figure 3A:
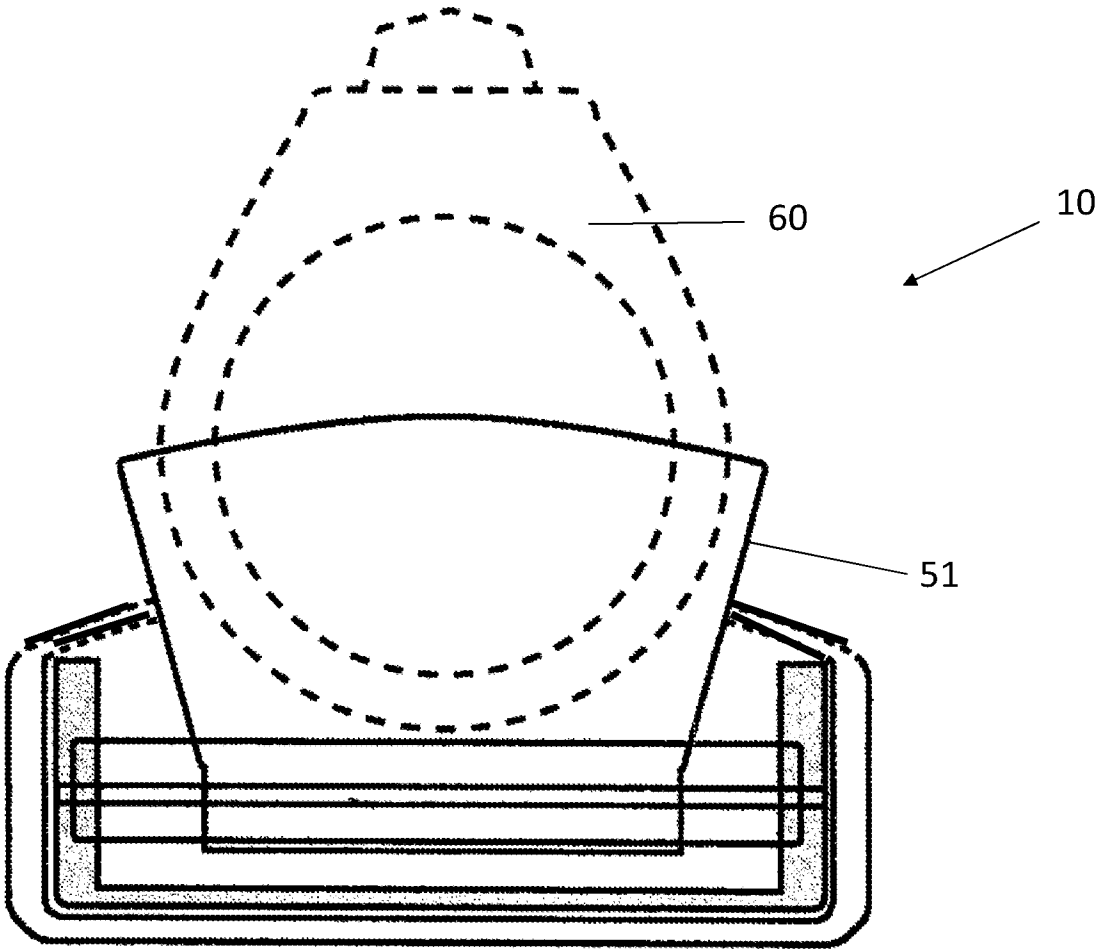
FIG. 3*a* is a front end view of the jewelry box in an opened position.
Figure 3B:
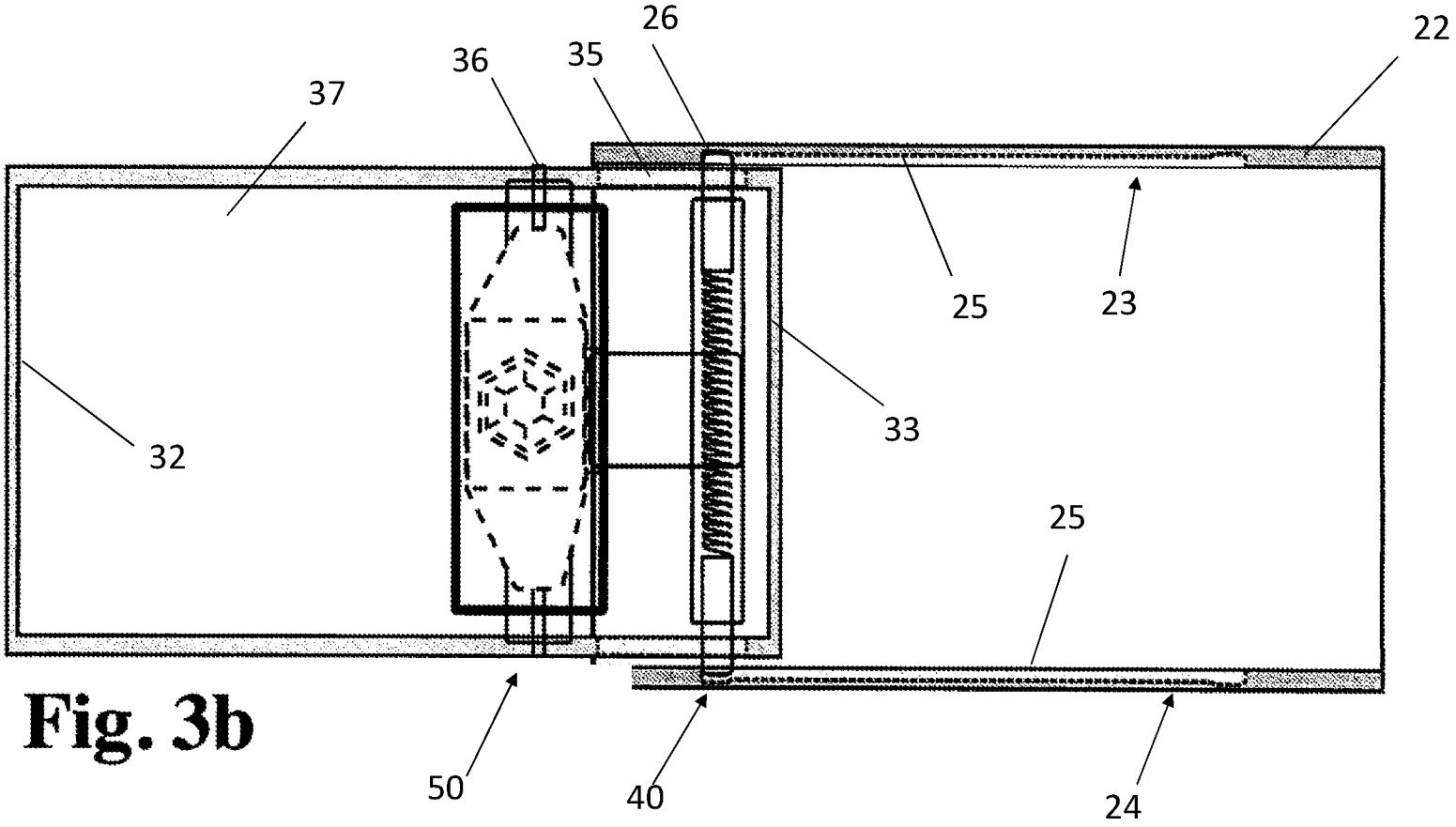
FIG. 3*b* is a top view of the jewelry box in an opened position.
Figure 3C:
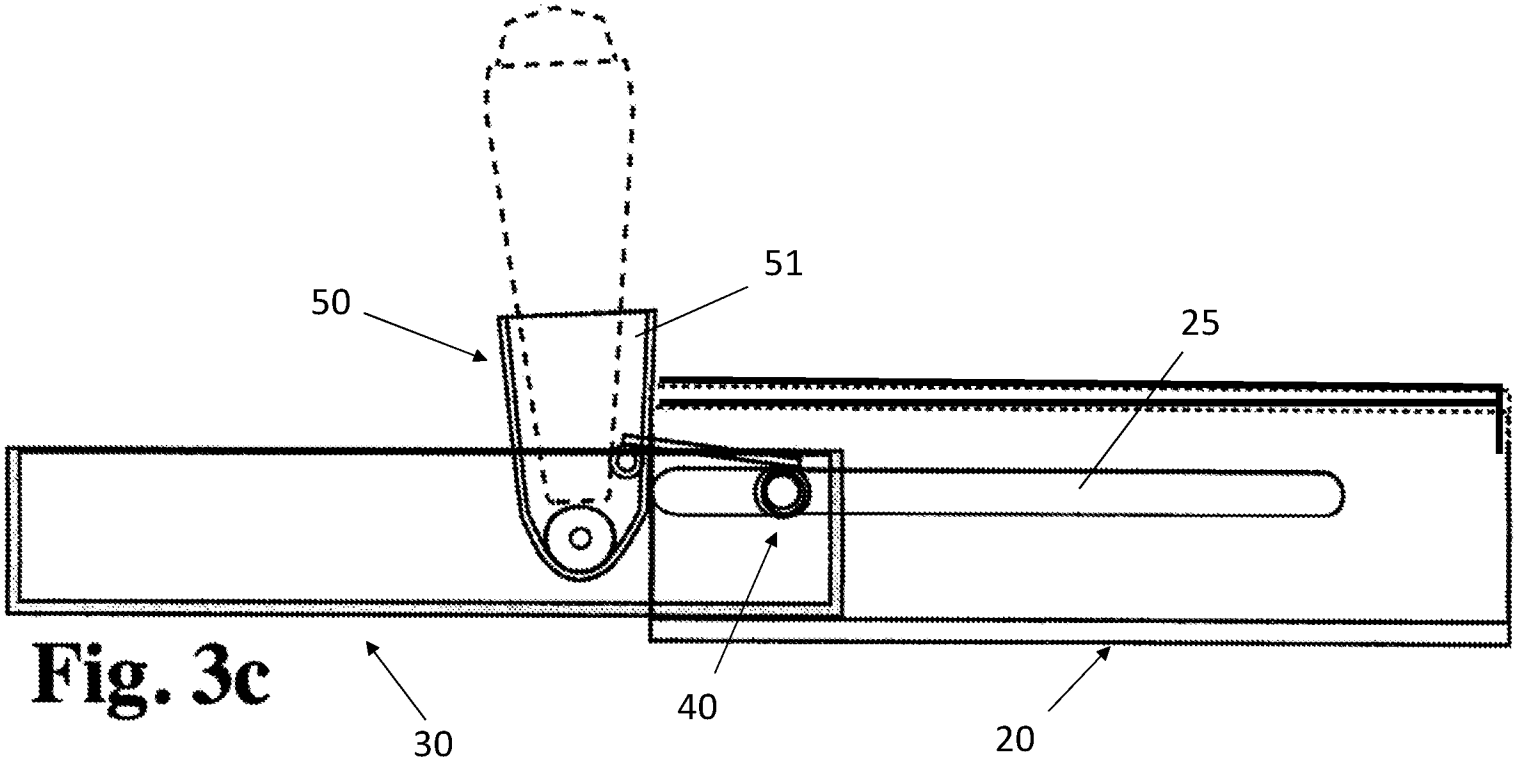
FIG. 3*c* is a side view of the jewelry box is an opened position.

The lift assembly works together with the jewelry holder to pivot the holder from a down position (see FIG. 2*b*) to an up position (see FIG. 3*a*). The down position is effected when the lid is in the closed position, and the up position is when the lid is in the opened position.

In use, as the lid is slid from the closed to the opened position, the pins slide along the guide grooves. When the pins hit the guide groove stops, the pins move the short distance along the guide slots, pulled by the stops as the lid is slid further open. The movement along the guide slots causes the lift assembly to move from the down position to the up position. The process is reversed when the lid is slid from the open position to the closed position. When the spring is biased closed, the spring pushes the assembly lift from the up position to the down position, not the lid.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A jewelry box comprising a lid, a drawer, a lift assembly and a jewelry holder;

wherein the lid comprises a top and two parallel sides, an interior surface and an exterior surface, and opposing guide grooves on the interior surface of the sides and parallel to the top, the grooves not extending through the sides to the exterior surface;

wherein the drawer comprises a bottom, a front wall, a rear wall, and two parallel drawer side walls, the walls defining a space; the drawer having opposing guide slots through the side walls proximate to the rear wall and in part, aligned with the guide grooves; the drawer having opposing pin holes through the sides walls proximate to the guide slots; wherein the lid and drawer sized to engage together and to slide to an opened position and a closed position;

wherein the lift assembly is positioned in the space of the drawer proximate to the rear wall and has an axis, the axis comprising a spring with a first end and a second end; the spring is biased downward; wherein positioned at the first and second end are guide pins; the guide pins are moveably mounted in the opposing guide slots of the drawer and the guide grooves of the lid; the lift assembly having a down position when the lid and drawer are in the closed position and an up position when the lid and drawer are in the opened position;

wherein the jewelry holder is positioned in the drawer space proximate to the lift assembly, the jewelry holder comprising a jewelry container having a top, a bottom and a pivot point, wherein the pivot point is positioned at the bottom of the container and has a pin having a pin first end and a pin second end, wherein the pin ends are rotatably engaged with the drawer pin holes; a clip fixedly engaged with the container and the spring so that as the lift assembly moves from the down position to the up position, the jewelry holder pivots from the down position to the up position so that the top of the jewelry container is rotated and held in the up position.

2. The jewelry box of claim 1, wherein positioned at the first end and second end of the spring are guide pins; the guide pins are moveably mounted in the opposing guide slots of the drawer and the guide grooves of the lid.

3. The jewelry box of claim 2, wherein the spring is biased downward.

4. The jewelry box of claim 3, wherein the pivot point of the jewelry container is positioned at the bottom of the container and has a pin having a pin first end and a pin second end, wherein the pin ends are rotatably engaged with the drawer pin holes.

5. The jewelry box of claim 1 wherein the lid has a bottom and fits the drawer like a sleeve.

6. The jewelry box of claim 1 wherein the lid has a bottom and fits the drawer like a sleeve.

7. The jewelry box of claim 5 wherein the guide slots in the drawer are much shorter than the guide grooves in the lid.

8. The jewelry box of claim 1 wherein the guide slots in the drawer are much shorter than the guide grooves in the lid.

9. The jewelry box of claim 6 wherein the guide slots are much shorter than the guide grooves.

10. The jewelry box of claim 1, wherein the lid has a bottom and fits the drawer like a sleeve, and wherein the top of the lid is curved.

* * * * *